US010265706B2

(12) United States Patent
Riera Domenech

(10) Patent No.: US 10,265,706 B2
(45) Date of Patent: Apr. 23, 2019

(54) SCRAPER DEVICE WITH BLOW NOZZLE AND TELESCOPIC GAS PIPES FOR CENTRIFUGE

(71) Applicant: RIERA NADEU, S.A., Granollers (ES)

(72) Inventor: Marc Riera Domenech, Barcelona (ES)

(73) Assignee: RIERA NADEU, S.A., Granollers (ES)

( * ) Notice: Subject to any disclaimer, the term of this patent is extended or adjusted under 35 U.S.C. 154(b) by 87 days.

(21) Appl. No.: 15/459,936

(22) Filed: Mar. 15, 2017

(65) Prior Publication Data

US 2017/0266671 A1 Sep. 21, 2017

(30) Foreign Application Priority Data

Mar. 17, 2016 (EP) ..... 16380009

(51) Int. Cl.

| | |
|---|---|
| ***B04B 15/06*** | (2006.01) |
| ***B04B 11/08*** | (2006.01) |
| ***B04B 11/04*** | (2006.01) |
| ***B08B 9/08*** | (2006.01) |
| ***B08B 7/04*** | (2006.01) |

(52) U.S. Cl.

CPC ..... *B04B 15/06* (2013.01); *B04B 11/04* (2013.01); *B04B 11/08* (2013.01); *B08B 7/04* (2013.01); *B08B 9/0808* (2013.01); *B08B 9/0813* (2013.01)

(58) Field of Classification Search

CPC ..... B04B 11/04; B04B 11/05; B04B 11/08; B04B 9/12; B04B 3/00; B04B 15/06; B08B 9/0813; B08B 7/04; B08B 9/0808

USPC ..... 210/372–376

See application file for complete search history.

(56) References Cited

U.S. PATENT DOCUMENTS 2,755,991 A * 7/1956 Tholl ..... B04B 11/08 210/375
3,309,015 A * 3/1967 Monteus ..... B04B 11/04 210/375
3,851,818 A * 12/1974 Pause ..... B04B 11/08 494/26

(Continued)

FOREIGN PATENT DOCUMENTS

CN 202010579 10/2011
CN 103934126 7/2014

(Continued)

OTHER PUBLICATIONS

European Search Report and written opinion of priority application No. 16380009.7 dated Sep. 8, 2016.

*Primary Examiner* — Charles Cooley
(74) *Attorney, Agent, or Firm* — Silvia Salvadori

(57) ABSTRACT

The scraper device for centrifuge includes a tubular runner mounted on a fixed base with the capacity to rotate around and slide along a vertical central axis through the action of a rotation actuator and an up and down actuator, respectively, a scraper assembly including a blade and an blow nozzle fixed at a lower end of the tubular runner, a tubular rod coaxially installed inside the tubular runner and fixed at its upper end to the fixed base by a support, and upper and lower gas pipes telescopically coupled to one another, located inside the tubular rod, fixed to the tubular rod and to the tubular runner, respectively, and connected to a pressurized gas supply device and to the blow nozzle, respectively.

12 Claims, 4 Drawing Sheets

(56) References Cited

U.S. PATENT DOCUMENTS

| | | | | |
|---|---|---|---|---|
| 10,124,347 | B2 * | 11/2018 | Meineke, Jr. | B04B 11/04 |
| 2016/0144382 | A1 * | 5/2016 | Riera-Domenech | B04B 1/02 494/27 |
| 2017/0266671 | A1 * | 9/2017 | Riera Domenech | B04B 15/06 |

FOREIGN PATENT DOCUMENTS

| | | | | |
|---|---|---|---|---|
| DE | 962598 | C * | 4/1957 | B04B 11/08 |
| DE | 2028267 | | 11/1984 | |
| EP | 3219392 | A1 * | 9/2017 | B04B 15/06 |

* cited by examiner

SCRAPER DEVICE WITH BLOW NOZZLE AND TELESCOPIC GAS PIPES FOR CENTRIFUGE

RELATED APPLICATION

This application is related to and claims priority to European Patent Application No. 16380009.7 filed 17 Mar. 2016, the contents of which are incorporated by reference as if set forth in their entirety.

FIELD OF THE ART

The present invention generally relates to a scraper device for centrifuge and more particularly to a scraper device for vertical centrifuge where a scraper assembly includes one or more gas blow nozzles and is provided with the capacity to move along a central axis parallel to the axis of rotation of the centrifuge and to rotate around the mentioned central axis.

BACKGROUND OF THE INVENTION

Centrifuges are known to be provided with a rotary centrifuging drum rotating around a vertical axis and a scraper device comprising a fixed base, a tubular runner mounted on said fixed base such that it can rotate around and slide along a vertical central axis under the action of respective actuators, and a scraper assembly fixed at a lower end of the tubular runner and arranged, in a working position, for scraping a cylindrical inner surface of the rotary centrifuging drum. The scraper assembly generally includes one or more blades and one or more gas blow nozzles connected to a pressurized gas supply device.

In such scraper devices, it is also known that the tubular runner is configured as a plunger arranged inside a tubular jacket to form an integrated hydraulic cylinder coaxial with the central axis, and a stationary tubular rod is arranged inside the tubular runner and a gas conduit inside the tubular rod, the gas conduit having an upper end connected to a pressurized gas supply device and a lower end fixed to the tubular runner and in fluid communication with the one or more blow nozzles.

Nevertheless, this arrangement has some drawbacks. First, the gas conduit must be long enough so that its upper end is located outside the tubular rod even when the tubular runner is in a lower limit position, and as a result, when the tubular runner is in an upper limit position, a considerable section of the gas conduit projects from the upper end of the tubular rod, which increases the need for available space above the centrifuge. On the other hand, there is the risk that, in the event of an unexpected failure of the joint elements arranged between the plunger and the jacket, the oil actuating the hydraulic cylinder mixes with the gas expelled from the blow nozzles and contaminates the materials that are being centrifuged.

Patent document CN 103934126 A discloses a scraper device for centrifuge including a fixed base, a tubular runner which has a vertical central axis and is mounted on the fixed base by first guiding means allowing the tubular runner to rotate around and slide along the central axis, a scraper assembly fixed at a lower end of the tubular runner, a linear up and down actuator which has a longitudinal axis parallel to the central axis and is arranged on one side of the tubular runner and operatively connected for imparting to the tubular runner upward and downward movements along the central axis, and a rotation actuator operatively connected for rotating the tubular runner around the central axis. Nevertheless, this scraper device does not include a pressurized gas blowing device.

Patent document CN 202570422 U discloses a scraper device for centrifuge including a pressurized gas blowing device where a flexible gas conduit is wound around the tubular runner, the flexible gas conduit having an upper end connected to a pressurized gas supply device and a lower end fixed to the tubular runner and in fluid communication with one or more blow nozzles.

BRIEF DESCRIPTION OF THE INVENTION

The present invention provides a scraper device for centrifuge comprising a fixed base, a tubular runner, a scraper assembly, an up and down actuator, a rotation actuator, one or more blow nozzles, a gas conduit and a tubular rod.

The tubular runner has a vertical central axis and is mounted on the fixed base by first guiding means allowing the tubular runner to rotate around and slide along the central axis. The scraper assembly comprises one or more blades and is fixed at a lower end of the tubular runner. The up and down actuator is separated from the tubular runner and operatively connected for imparting to the tubular runner upward and downward movements along the central axis. The rotation actuator is operatively connected for rotating the tubular runner around the central axis.

The one or more blow nozzles are installed in the scraper assembly adjacent to the one or more blades. The tubular rod is coaxially installed inside the tubular runner and fixed at its upper end to the fixed base by means of a support, and second guiding means are arranged between the tubular runner and the tubular rod. Upper and lower gas pipes telescopically coupled to one another are located inside the tubular rod. The upper gas pipe has an upper end fixed to the tubular rod and in fluid communication with a pressurized gas supply device. The lower gas pipe has a lower end fixed to the tubular runner and in fluid communication with the one or more blow nozzles.

Therefore, when the up and down actuator moves the tubular runner together with the scraper assembly upwards and downwards, the lower gas pipe moves together with the tubular runner whereas the upper gas pipe and its fluid connection with the pressurized gas supply device remain stationary.

In one embodiment, an outer tubular casing is arranged coaxially around the tubular runner. This outer tubular casing has a lower end fixed to the fixed base, and the upper end of the tubular rod is fixed to an upper end of the outer tubular casing, such that outer tubular casing and the tubular rod are stationary with respect to the fixed base.

An intermediate tubular jacket is mounted coaxially between the outer tubular casing and the tubular runner. Third guiding means allow the intermediate tubular jacket to rotate around but not slide along the central axis with respect to the outer tubular casing, and fourth guiding means allow the tubular runner to slide along but not rotate around the central axis with respect to the intermediate tubular jacket. Therefore, the tubular runner rotates together with the intermediate tubular jacket in relation with the outer tubular casing and the inner tubular rod while at the same time the tubular runner can slide axially in relation with the outer tubular casing, the intermediate jacket and the inner tubular rod.

In one embodiment, the up and down actuator is a linear actuator which has a longitudinal axis parallel to the central axis and is arranged on one side of the tubular runner. This linear up and down actuator has a fixed part connected to the intermediate tubular jacket by a first connecting arm going through a window formed in the outer tubular casing and a moving part connected to the tubular runner by a second connecting arm going through the window formed in the outer tubular casing and through a longitudinal through slit formed in the intermediate tubular jacket.

For example, the up and down actuator can be a hydraulic cylinder provided with an extendible rod acting as the fixed part and a cylinder body acting as the moving part. Alternatively, the up and down actuator can be a hydraulic cylinder provided with an extendible rod acting as the moving part and a cylinder body acting as the fixed part.

In one embodiment, the rotation actuator is a linear actuator having a longitudinal axis perpendicular to the central axis, and this linear actuator has a fixed part connected to the fixed base and a moving part connected to a linear rack which meshes with a gear wheel fixed coaxially to the intermediate tubular jacket. For example, the linear rotation actuator can be a hydraulic cylinder provided with a cylinder body acting as the fixed part and an extendible rod acting as the moving part. Alternatively, the rotation actuator can comprise a pair of pistons fixed to opposite ends of the linear rack and two opposite and mutually aligned cylinder bodies fixed to the fixed base, each of the pistons being inserted in a sliding manner in one of the cylinder bodies, such that the pair of pistons act as the moving part and the cylinder bodies act as the fixed part.

In another alternative embodiment, the rotation actuator is a linear actuator having a longitudinal axis perpendicular to the central axis, a fixed part connected to the fixed base through a support and a moving part connected to a rocker arm which is in turn connected to the tubular runner such that it can slide along but not rotate around the central axis with respect to the tubular runner. For example, this rotation actuator can be a hydraulic cylinder provided with a cylinder body acting as the fixed part and an extendible rod acting as the moving part.

In any of the embodiments, the first, second and third guiding means can comprise, for example, respective friction bearings and/or scraper rings.

The fourth guiding means can comprise, for example, one or more keys fixed to the tubular runner and one or more longitudinal slits formed on an inner surface of the intermediate tubular jacket, the keys being coupled to the longitudinal slits.

The features described above provide the scraper device for centrifuge of the present invention several advantages, among which the following stands out:

a) The scraper device works without the presence of oil or grease inside the outer tubular casing or inside the tubular runner, which eliminates the risk of contamination with hydraulic oil or grease which would be there if the tubular runner were hydraulically actuated by means of a plunger or by means of a nut and spindle actuation inside the outer casing.

This is because in the scraper device of the present invention both the actuator actuating the axial upward and downward movement and the actuator actuating the rotation are located outside the tubular runner and outside the outer tubular casing, such that in the event of oil or grease leakage, said leakage will never be able to contaminate the gas injected through the inner gas conduit or the centrifuged product.

b) The gas conduit does not extend upwards from the upper end of the tubular rod or the outer tubular casing when the tubular runner is moved upwards by the up and down actuator as occurs with devices of the state of the art, which reduces the general volume of the scraper device and the subsequent space necessary for its installation and operation.

This is because in the scraper device of the present invention the gas conduit comprises a pair of gas pipes telescopically coupled to one another.

BRIEF DESCRIPTION OF THE DRAWINGS

The foregoing and other features and advantages will be better understood based on the following detailed description of several merely illustrative and non-limiting embodiments in reference to the attached drawings, in which.

DETAILED DESCRIPTION OF SEVERAL EMBODIMENTS

Figure 1:
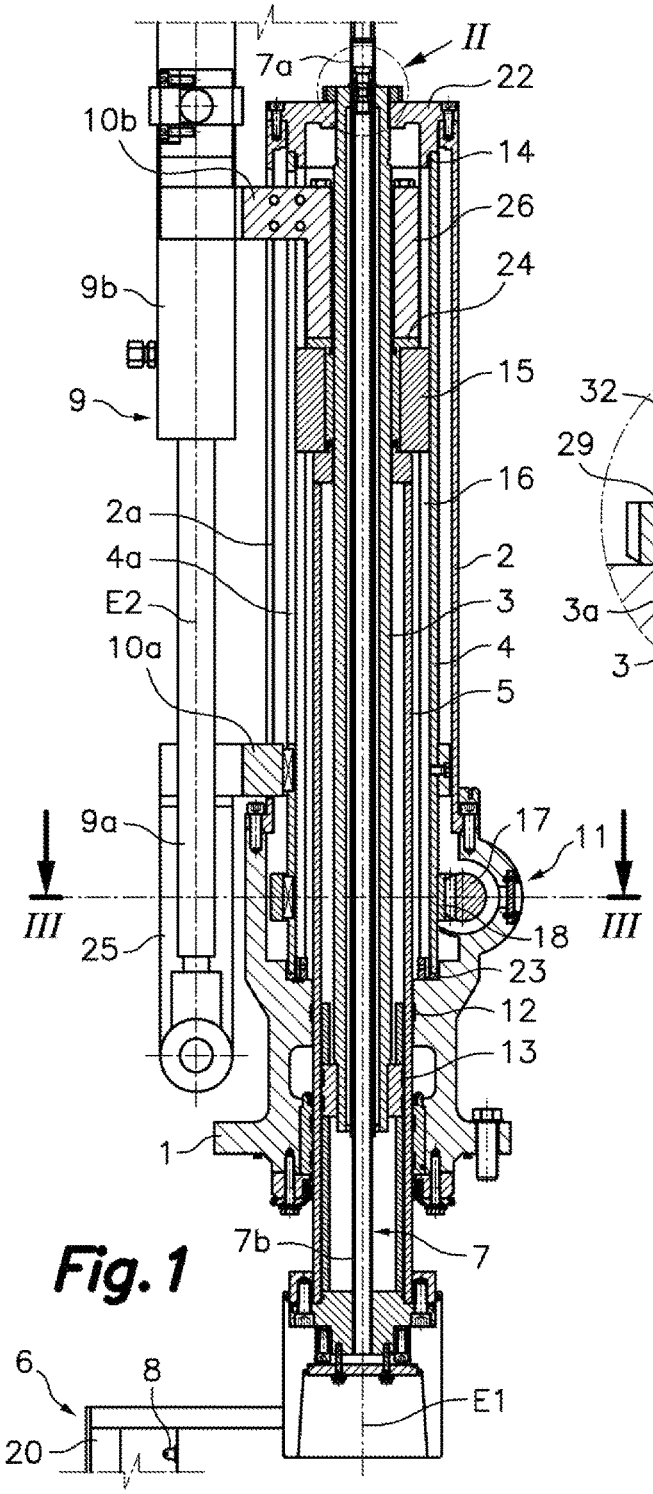
FIG. 1 shows a cross-section view taken along a central vertical plane of a scraper device for centrifuge according to one embodiment of the present invention.
Figure 2:
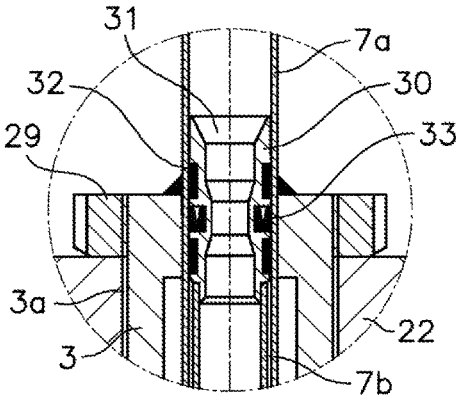
FIG. 2 shows an enlarged view of detail II of FIG. 1.
Figure 3:
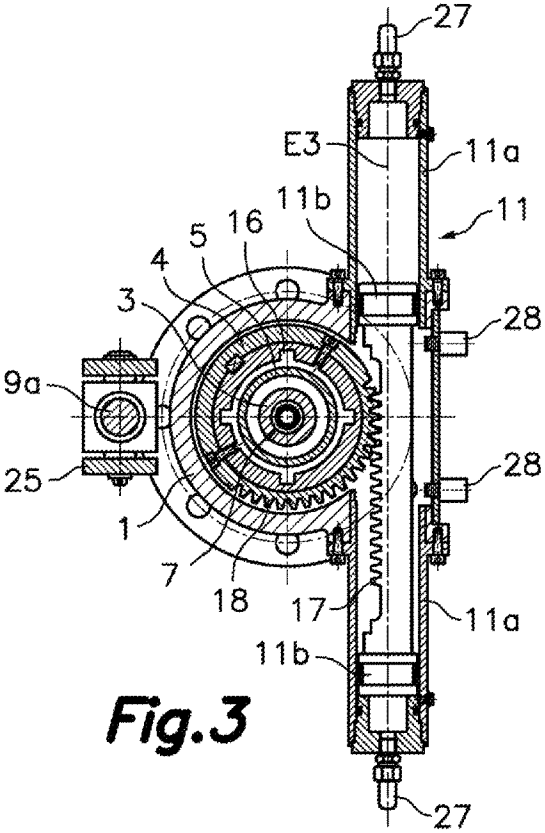
FIG. 3 shows a cross-section view taken along plane III-III of FIG. 1.

Referring first to FIGS. 1, 2 and 3, the scraper device for centrifuge of the present invention comprises, according to one embodiment, a fixed base 1 having an opening around a vertical central axis E1, and a tubular runner 5 which is mounted coaxially in the opening of the fixed base 1 by first guiding means made up of friction bearings 12 allowing the tubular runner 5 to rotate around and slide along the central axis E1 in relation with the fixed base 1. A scraper assembly 6 including one or more blades 20 and one or more blow nozzles 8 is fixed at a lower end of the tubular runner 5.

There is arranged coaxially around the tubular runner 5 an outer tubular casing 2 having a lower end fixed to the fixed base 1 and an upper end to which a closure element 22 having a central opening is fixed. A tubular rod 3 having its upper end inserted in the central opening of the closure element 22 and fixed to the closure element 22 is coaxially installed inside the tubular runner 5. As a result, the tubular rod 3 is fixed to the fixed base 1 by means of a support provided by the outer tubular casing 2 and the closure element 22. Friction bearings 13 making up second guiding means allowing the tubular runner 5 to rotate around and slide along the central axis E1 also in relation with the stationary tubular rod 3 are arranged between the tubular runner 5 and the tubular rod 3.

An intermediate tubular jacket 4 is arranged coaxially between the outer tubular casing 2 and the tubular runner 5. A friction bearing 14 is arranged between the closure element 22 and an upper end of the intermediate tubular jacket 4 and a support ring 23 made of a material with a low coefficient of friction is arranged between the fixed base and a lower end of the intermediate tubular jacket 4, such that the friction bearing 14 and the support ring 23 make up third guiding means allowing the intermediate tubular jacket 4 to rotate around but not slide along the central axis E1 with respect to the outer tubular casing 2.

A guide sleeve 24 having installed thereon one or more projecting keys 15 is fixed at an upper end of the tubular runner 5, and one or more corresponding longitudinal slits 16 are formed on an inner surface of the intermediate tubular jacket 4. The keys 15 are coupled to the longitudinal slits 16. Therefore, the keys 15 and the longitudinal slits 16 make up fourth guiding means allowing the tubular runner 5 to slide along but not rotate around the central axis E1 with respect to the intermediate tubular jacket 4.

An up and down actuator 9 is operatively connected for imparting to the tubular runner 5 upward and downward movements along the central axis E1 in relation with the fixed base 1, and a rotation actuator 11 is operatively connected for rotating the tubular runner 5 around the central axis E1 in relation with the fixed base 1.

In the embodiment shown in FIG. 1, the up and down actuator 9 is a linear actuator made up of a hydraulic cylinder which has a longitudinal axis E2 parallel to the central axis E1 and is arranged outside the outer tubular casing 2. The hydraulic cylinder making up the linear up and down actuator 9 has an extendible rod making up a fixed part 9*a* connected to the intermediate tubular jacket 4 and a cylinder body making up a moving part 9*b* connected to the tubular runner 5.

More specifically, the extendible rod is connected to a support 25 having a first connecting arm 10*a* fixed to the intermediate tubular jacket 4. This first connecting arm 10*a* goes through a window 2*a* formed in the outer tubular casing 2. The cylinder body is fixed to a second connecting arm 10*b* having a connecting sleeve 26 fixed to an upper end of the tubular runner 5. This second connecting arm 10*b* goes through the mentioned window 2*a* formed in the outer tubular casing 2 and through a longitudinal through slit 4*a* formed in the intermediate tubular jacket 4. The connecting sleeve 26 can rotate around the central axis E1 in relation with the tubular rod 3.

Therefore, activation of the up and down actuator 9 moves the tubular runner 5 upwards and downwards along the central axis E1 in relation with the fixed base 1 and with the elements fixed thereto, such as the outer tubular casing 2 and the tubular rod 3, thereby imparting an upward and downward movement to the scraper assembly 6 fixed at the lower end of the tubular runner 5.

As better shown in FIG. 3, the rotation actuator 11 is a linear actuator having a longitudinal axis E3 perpendicular to the central axis E1 and comprising two opposite and mutually aligned cylinder bodies making up a fixed part 11*a* connected to the fixed base 1 and a pair of pistons inserted in a sliding manner in the two cylinder bodies and making up a moving part 11*b* connected to opposite ends of a linear rack 17 which meshes with a gear wheel 18 fixed coaxially to the intermediate tubular jacket 4 through a window formed in the fixed base 1. The two cylinder bodies are connected to a hydraulic fluid supply circuit by means of respective adaptors 27, and end-of-travel detectors 28 are installed in the fixed base 1.

Therefore, activation of the rotation actuator 11 rotates the intermediate tubular jacket 4 a specific angle around the central axis E1 in relation with the fixed base 1 and with the elements fixed thereto, such as the outer tubular casing 2 and the tubular rod 3, thereby imparting a rotational movement to the scraper assembly 6 fixed at the lower end of the tubular runner 5. Given that the first connecting arm 10*a* of the support 25 supporting the fixed part 9*a* of the up and down actuator 9 is fixed to the intermediate tubular jacket 4, the up and down actuator 9 rotates together with intermediate tubular jacket 4 and the scraper assembly 6.

Rotation of the scraper assembly around the central axis E1 occurs between an angular working position, in which an edge of the blade 20 is very close to a cylindrical inner surface of the centrifuging drum and the blow nozzle 8 is directed towards such cylindrical inner surface for scraping a material adhered to said surface due to centrifugation, and an angular removal position, in which the scraper assembly 6 can be removed from the centrifuging drum through an upper opening thereof.

When the scraper assembly 6 is in the angular working position, the upward and downward movement of the scraper assembly is used for vertically tracing the entire extension of the cylindrical inner surface of the centrifuging drum while the centrifuging drum rotates, and when the scraper assembly 6 is in the angular removal position, the upward and downward movement of the scraper assembly is used for removing the scraper assembly 6 from the centrifuging drum and reintroducing it in the centrifuging drum.

A gas conduit 7 formed by upper and lower gas pipes 7*a*, 7*b* telescopically coupled to one another is located inside the tubular rod 3, where the upper gas pipe 7*a* has an upper end fixed to an upper end of the tubular rod 3 and the lower gas pipe 7*b* has an upper section inserted in the upper gas pipe 7*a* and a lower end fixed to a lower end of the tubular runner 5, such that when the tubular runner 5 performs an upward movement the length of the section of the lower gas pipe 7*b* introduced inside the upper gas pipe 7*a* increases and the gas conduit 7 is telescopically shortened, and when the tubular runner 5 performs a downward movement the length of the section of the lower gas pipe 7*b* removed from inside the upper gas pipe 7*a* increases and the gas conduit 7 is telescopically elongated.

The upper end of the upper gas pipe 7*a* is in fluid communication with a pressurized gas supply device (not shown) and the lower end of the lower gas pipe 7*b* is in fluid communication with the blow nozzle 8 or with a manifold distributing gas to several blow nozzles 8, for example, by means of one or more flexible sleeves (not shown) or another type of ducts between the lower end of the lower gas pipe 7*b* and the one or more blow nozzles 8. A commonly used gas in centrifuges of this type is nitrogen.

FIG. 2 shows an enlarged detail of the telescopic coupling between the upper and lower gas pipes 7*a*, 7*b*. The upper gas pipe 7*a* is fixed by welding to the tubular rod 3 and the tubular rod 3 is fixed by means of coupling a bolt 3*a* and a locknut 29 to the central opening of the closure element 22. The upper end of the lower gas pipe 7*b* is fixed to an adjustment sleeve 30 having a central passage 31 and an outer surface on which there are installed friction bearings 32 and a retainer 33 working against an inner surface of the upper gas pipe 7*a*.

It will be understood that, alternatively, and according to a reverse construction, the upper gas pipe 7*a* may have a lower section inserted in the lower gas pipe 7*b* with an equivalent result.

Figure 4:
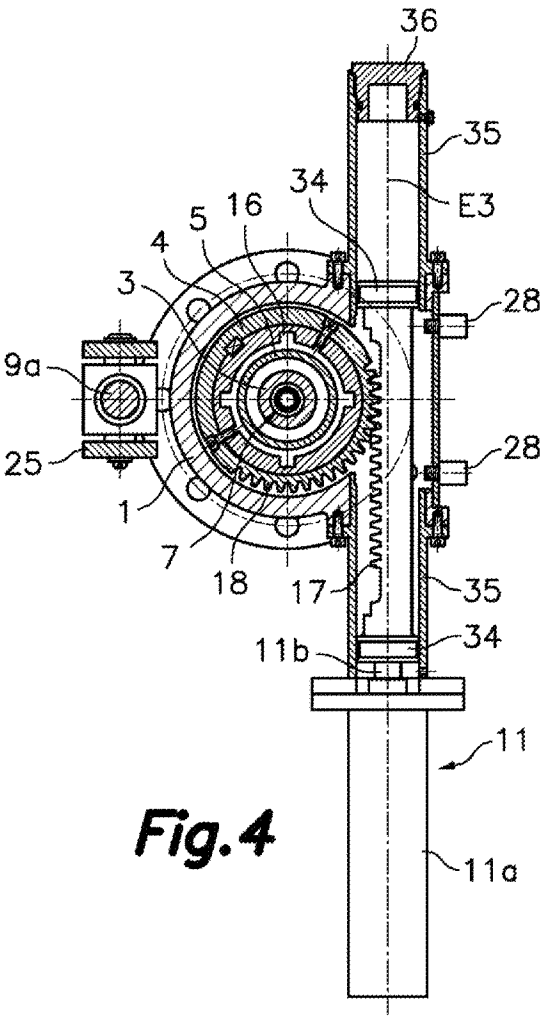
FIG. 4 shows a cross-section view similar to FIG. 3 showing a variant of the embodiment of FIG. 1.

FIG. 4 shows an alternative variant of the embodiment of the rotation actuator 11 described above in relation with FIGS. 1 and 3. In the variant shown in FIG. 4, the rotation actuator 11 is a hydraulic cylinder having a longitudinal axis E3 perpendicular to the central axis E1, a cylinder body acting as the fixed part 11*a* connected to the fixed base 1 and an extendible rod acting as the moving part 11*b* connected to the linear rack 17. There are fixed on the opposite ends of the linear rack 17 a pair of guiding elements 34 inserted in a sliding manner in respective opposite and mutually aligned tubular guiding elements 35 fixed to the fixed base 1. The cylinder body of the hydraulic cylinder is fixed at one end of one of the tubular guiding elements 35 and the opposite end of the other one of the tubular guiding elements 35 is closed by a cover 36.

Figure 5:
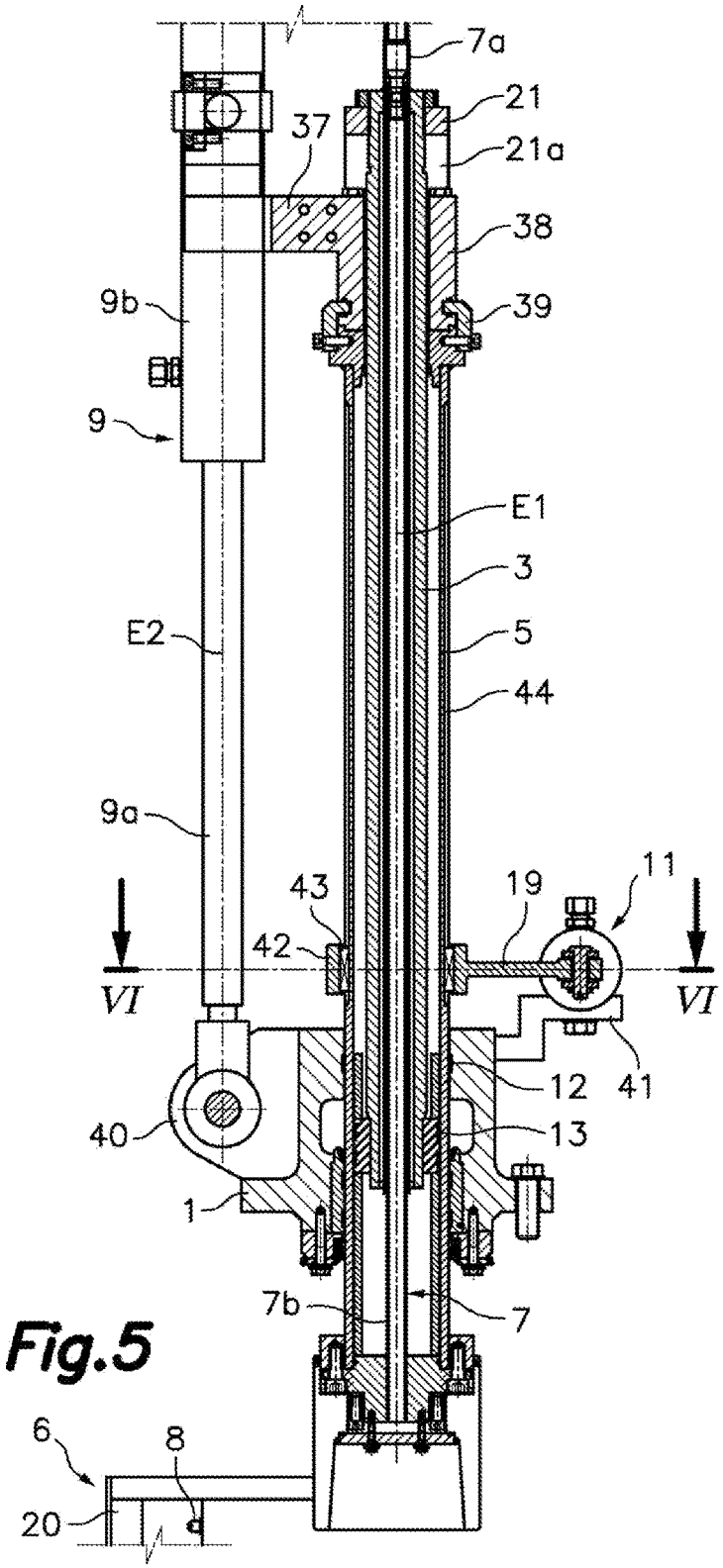
FIG. 5 shows a cross-section view taken along a central vertical plane of a scraper device for centrifuge according to another embodiment of the present invention.
Figure 6:
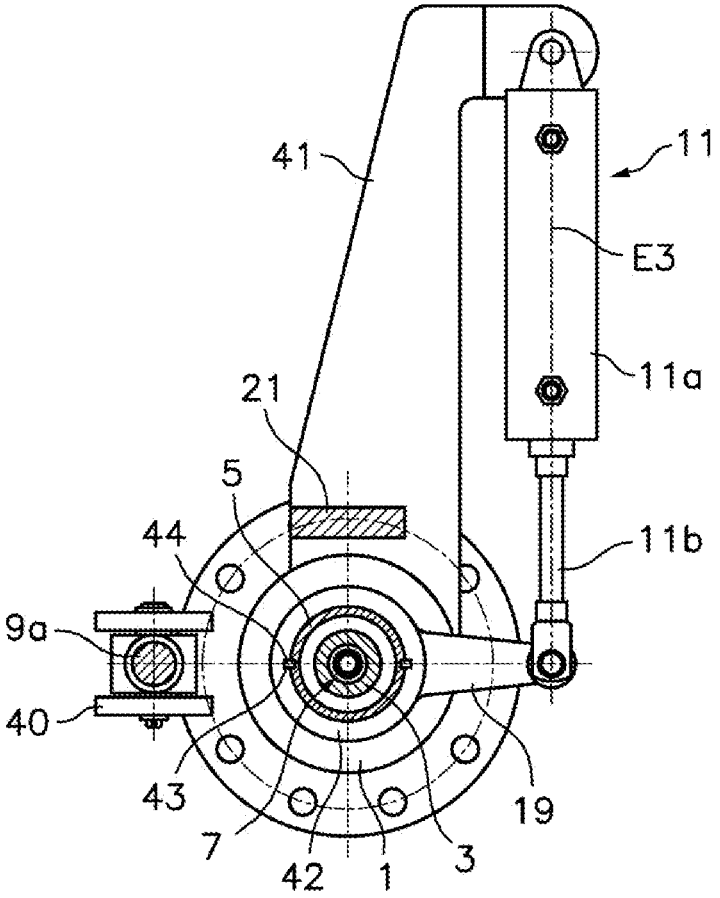
FIG. 6 shows a cross-section view taken along plane VI-VI of FIG. 5.

FIGS. 5 and 6 show another simplified alternative embodiment of the scraper device for centrifuge of the present invention. The alternative embodiment shown in FIGS. 5 and 6 comprises a tubular runner 5 which has a vertical central axis E1 and is mounted on a fixed base 1 by first guiding means, such as friction bearings 12, allowing the tubular runner 5 to rotate around and slide along the central axis E1 in relation with the fixed base 1. A scraper assembly 6 having fixed thereto one or more blades 20 and one or more blow nozzles 8 is fixed at a lower end of the tubular runner 5.

A tubular rod 3 having its upper end fixed to the fixed base 1 by means of a support 21 attached to the fixed base 1 through a stud 21*a* is coaxially installed inside the tubular runner 5. Second guiding means, such as friction bearings 13, allowing the tubular runner 5 to rotate around and slide along the central axis E1 also in relation with the tubular rod 3 are arranged between the tubular runner 5 and the tubular rod 3.

An up and down actuator 9 is operatively connected for imparting to the tubular runner 5 upward and downward movements along the central axis E1 in relation with the fixed base 1, and a rotation actuator 11 is operatively connected for rotating the tubular runner 5 around the central axis E1 in relation with the fixed base 1.

In the alternative embodiment shown in FIGS. 5 and 6, the up and down actuator 9 is a linear actuator made up of a hydraulic cylinder which has a longitudinal axis E2 parallel to the central axis E1 and is arranged on one side of the tubular runner 5. The hydraulic cylinder making up the linear up and down actuator 9 has an extendible rod making up a fixed part 9*a* directly connected to a fork 40 of the fixed base 1 and a cylinder body making up a moving part 9*b* connected to the tubular runner 5 by means of a connecting arm 37 having a connecting sleeve 38 coupled to an upper end of the tubular runner 5 by means of a rotary coupling 39. The tubular runner 5 can therefore rotate around the central axis E in relation with the connecting sleeve 38.

The rotation actuator 11 is a hydraulic cylinder having a longitudinal axis E3 perpendicular to the central axis E1, a cylinder body which acts as the fixed part 11*a* and is connected to the fixed base 1 by means of a support 41 attached to the fixed base 1, and an extendible rod which acts as the moving part 11*b* and is connected to a rocker arm 19, which is in turn connected to the tubular runner 5 by means of a connecting ring 42. The connecting ring 42 has one or more keys 43 projecting from an inner surface which are coupled in a sliding manner to one or more longitudinal slits 44 formed on an outer surface of the tubular runner 5, such that the connecting ring 42 can slide along but not rotate around the central axis E1 with respect to the tubular runner 5.

A gas conduit formed by upper and lower gas pipes 7*a*, 7*b* telescopically coupled to one another in the manner described above in relation with FIGS. 1 and 2 is located inside the tubular rod 3. The upper gas pipe 7*a* has an upper end fixed to an upper end of the tubular rod 3 and the lower gas pipe 7*b* has a lower end fixed to a lower end of the tubular runner 5, such that when the tubular runner 5 performs the mentioned upward and downward movements, the gas conduit is shortened and elongated as a result of the telescopic coupling of the upper and lower gas pipes 7*a*, 7*b*.

The upper end of the upper gas pipe 7*a* is in fluid communication with a pressurized gas supply device (not shown) and the lower end of the lower gas pipe 7*b* is in fluid communication with the blow nozzle 8 or with a manifold distributing gas to several blow nozzles 8, for example, by means of one or more flexible sleeves (not shown) or another type of ducts.

The preceding merely illustrates the principles of embodiments of the disclosure. It will thus be appreciated that those skilled in the art will be able to devise various arrangements which, although not explicitly described or shown herein, embody the principles of the invention and are included within its spirit and scope. Furthermore, all examples and conditional language recited herein are principally intended expressly to be only for pedagogical purposes and to aid the reader in understanding the principles of the invention and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

The invention claimed is:

1. A scraper device for centrifuge comprising:

a fixed base;

a tubular runner which has a vertical central axis and is mounted on said fixed base by first guides allowing said tubular runner to rotate around and slide along said vertical central axis;

a scraper assembly fixed at a lower end of said tubular runner, said scraper assembly including at least one blade;

an up and down actuator operatively connected for imparting to the tubular runner upward and downward movements along the vertical central axis; and a rotation actuator operatively connected for rotating the tubular runner around the vertical central axis;

wherein:

at least one blow nozzle is fixed to the scraper assembly;

a tubular rod is coaxially installed inside the tubular runner and fixed at its upper end to the fixed base by means of a support, second guides being arranged between the tubular runner and said tubular rod, upper and lower gas pipes telescopically coupled to one another are located inside said tubular rod, wherein said upper gas pipe has an upper end fixed to the tubular rod and in fluid communication with a pressurized gas supply device and said lower gas pipe has a lower end fixed to the tubular runner and in fluid communication with said at least one blow nozzle.

2. The scraper device for centrifuge according to claim 1, wherein an outer tubular casing is arranged coaxially around the tubular runner and has a lower end fixed to the fixed base, and said upper end of the tubular rod is fixed to an upper end of the outer tubular casing.

3. The scraper device for centrifuge according to claim 2, wherein an intermediate tubular jacket is mounted coaxially between the outer tubular casing and the tubular runner, wherein third guides are provided which allow said intermediate tubular jacket to rotate around but not slide along the vertical central axis with respect to the outer tubular casing, and wherein at least one fourth guide is provided which allows the tubular runner to slide along but not rotate around the vertical central axis with respect to the intermediate tubular jacket.

4. The scraper device for centrifuge according to claim 3, wherein said up and down actuator is a linear actuator having a longitudinal axis parallel to the vertical central axis, a fixed part connected to the intermediate tubular jacket by a first connecting arm going through a window formed in the outer tubular casing and a moving part connected to the tubular runner by a second connecting arm going through said window formed in the outer tubular casing and through a longitudinal through slit formed in the intermediate tubular jacket.

5. The scraper device for centrifuge according to claim 4, wherein the up and down actuator is a hydraulic cylinder having an extendible rod acting as said fixed part and a cylinder body acting as said moving part.

6. The scraper device for centrifuge according to claim 3, wherein said rotation actuator is a linear actuator having a longitudinal axis perpendicular to the vertical central axis, a fixed part connected to the fixed base and a moving part connected to a linear rack which meshes with a gear wheel fixed coaxially to the intermediate tubular jacket.

7. The scraper device for centrifuge according to claim 6, wherein the rotation actuator is a hydraulic cylinder having a cylinder body acting as said fixed part and an extendible rod acting as said moving part.

8. The scraper device for centrifuge according to claim 6, wherein the rotation actuator comprises a pair of pistons which are fixed to opposite ends of said linear rack acting as said moving part and which are inserted in a sliding manner in two opposite aligned cylinder bodies which are fixed to the fixed base and which act as said fixed part.

9. The scraper device for centrifuge according to claim 3, wherein said first, second and third guides comprise respective friction bearings.

10. The scraper device for centrifuge according to claim 3, wherein said at least one fourth guide comprise at least one key installed in the tubular runner and at least one longitudinal slit formed on an inner surface of the intermediate tubular jacket, said at least one key being coupled to said at least one longitudinal slit.

11. The scraper device for centrifuge according to claim 1, wherein said rotation actuator is a linear actuator having a longitudinal axis perpendicular to the vertical central axis, a fixed part connected to the fixed base through a support and a moving part connected to a rocker arm which is in turn connected to the tubular runner such that the rocker arm can slide along but not rotate around the vertical central axis with respect to the tubular runner.

12. The scraper device for centrifuge according to claim 11, wherein the rotation actuator is a hydraulic cylinder having a cylinder body acting as said fixed part and an extendible rod acting as said moving part.

* * * * *